United States Patent [19]

Chou et al.

[11] 4,369,802

[45] Jan. 25, 1983

[54] WIRE GALVANIZER COOLER

[75] Inventors: Clifford K. F. Chou, Antioch; Paul McCarthy, Concord, both of Calif.

[73] Assignee: United States Steel Corporation, Pittsburgh, Pa.

[21] Appl. No.: 281,443

[22] Filed: Jul. 8, 1981

[51] Int. Cl.[3] ..... B05C 3/04

[52] U.S. Cl. ..... 134/122 R; 118/69; 134/154; 134/183

[58] Field of Search ..... 118/69, 419, DIG. 19, 118/429, 405; 427/398.3; 134/64, 122 R, 154, 182, 183; 266/112

[56] References Cited

U.S. PATENT DOCUMENTS

| | | | |
|---|---|---|---|
| 2,898,627 | 8/1959 | Bley et al. | 134/64 R X |
| 3,096,214 | 7/1963 | Wells, Jr. et al. | 134/122 R X |
| 4,124,932 | 11/1978 | Rogove et al. | 118/69 X |

*Primary Examiner*—John P. McIntosh

*Attorney, Agent, or Firm*—John F. Carney

[57] ABSTRACT

Plural strands of wire emerging from the cooling tower of a galvanizing line are cooled from about an elevated temperature to ambient temperature by heat exchange apparatus in which the strands are passed through an agitated, flowing stream of cooling water. The apparatus is designed to accommodate knots that connect strands in end-to-end relation or other strand surface irregularities. It also permits disorientation of the strands from their respective pass lines without disrupting operation of the apparatus.

1 Claim, 3 Drawing Figures

WIRE GALVANIZER COOLER

BACKGROUND OF THE INVENTION

This invention relates to apparatus for cooling plural strands of wire emerging from a galvanizing or other hot-dip operation in order that the wire can be handled without marring the surface coating and without danger to a workman.

In the galvanizing of wire material, especially such material as is air cooled following the hot-dip operation, the temperature of the material that is wound on the recoiling spools is at an elevated level, being of the order of 400° F. At this temperature the surface coating has not completely solidified and is in a somewhat plastic state. Such material is troublesome to handle, both from the standpoint of danger of marring or otherwise distorting the surface of the coated wire by its contact with handling equipment as well as from that of creating a hazardous environment in which a workman may be burned. Moreover, if the coated wire is in a plastic state when wound on the recoiling spools adjacent wraps have a tendency to become weldedly united requiring much effort to separate them and often at a cost of having to reject the affected length of material.

It is known to subject wire to a subsequent cooling operation following the quenching step in a galvanizing process. Such an expedient is disclosed in U.S. Pat. No. 4,177,754 wherein each wire in the pass line is caused to traverse an individual trough through which cooling liquid is conducted in counter-flow relation to the traverse of the wire. Such a cooling arrangement is undesirable in many applications such as, for example, those in which the temperature of the wire entering the heat exchanger is excessively high; those in which many wires are disposed in close center-to-center relation; and those in which the attitude of the pass line prevents cooling liquid to be gravity-fed in counter-flow relation to the moving wire.

It is to the solution of such problems therefore that the present invention is directed.

SUMMARY OF THE INVENTION

The present invention provides apparatus for cooling continuous lengths of wire comprising a cooling chamber, means for moving the wire to be cooled along a pass line through said chamber, means for circulating cooling liquid through said chamber, and baffle means within said chamber for agitating the circulated cooling liquid and for conducting it in cross-flow relation with respect to said wire.

It is a principal object of the invention to provide a heat exchange apparatus that is operative to effectively cool plural strands of molten metal-coated wire of the same or diverse diameters from elevated temperatures substantially to ambient temperature.

Another object of the invention is to provide heat exchange apparatus of the described type in which heat transfer from the wire to the cooling liquid is optimized by agitation of the cooling liquid and by insuring that throughout at least part of the pass line the wire moves in countercurrent relation to the flow of cooling liquid.

Yet another object of the invention is to provide heat exchange apparatus of the described type through which the wire strands of the same or diverse diameters can be guided without danger of marring the coated surfaces thereof by guide means that accommodate accidental transposition of the strands and knots or other distortions that may exist in the wire strand without detriment to system operation.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
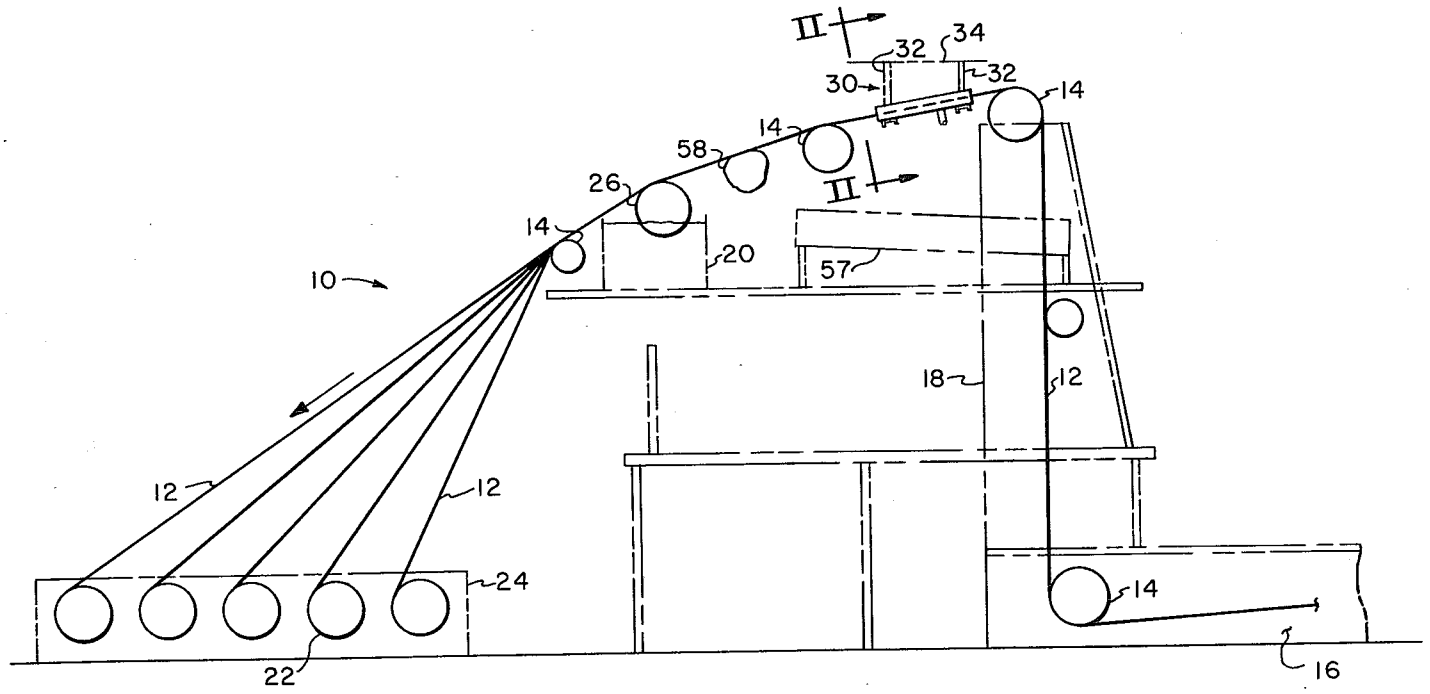
FIG. 1 is a schematic representation of a wire galvanizing line incorporating the heat exchanger of the present invention.

FIG. 1 of the drawing illustrates a typical wire galvanizing line 10 for which the present invention has particular utility. Along the line 10 a plurality of wire strands 12 are guided by means of sheaves 14 or equivalent guide pulleys through zinc pan 16, cooling tower 18, and wax pot 20 for ultimate reception on the respective spools 22 of a take-up frame 24. The zinc pan 16 contains a body of molten zinc at a temperature of about 800° F. for imparting a galvanizing coating to the wire surface. The strands pass upwardly from the pan through the cooling tower 18 where the coating is cooled by contact with ambient air to a temperature typically at about 400° F. Prior to being coiled onto the spools 22 the strands are caused to pass over a waxing roll 26 by means of which their surfaces are coated with a layer of molten wax in order to protect the product against atmospheric degradation.

It will be appreciated that, prior to the interposition of the heat exchanger 30 of the present invention as hereinafter described, the wire strands exiting the cooling tower 18 were extremely hot. Operators working at the take-up frame were in danger of being burned as a result of contacting the hot wire. Moreover, coiling the wire in an overheated condition resulted in the danger of the wraps of wire on the respective spools tending to become bonded together which is obviously undesirable.

According to the present invention, therefore, heat exchanger 30 is positioned in the line 10 immediately adjacent the exit end of the cooling tower 18 and is adapted to conduct cooling water in direct contact relation with the wire strands in amounts sufficient to reduce the wire temperature to about ambient temperature. The heat exchanger 30 comprises a box-like casing inclined in the direction of the wire pass line and is here shown as being suspended by rods 32 and support braces 33 from an overhead beam 34. The casing is formed essentially of metal and includes oppositely spaced upstanding metal side plates 36 and 38 weldedly interconnected at their lower ends by a bottom plate 40. The top of the casing is formed by a removable cover 42 that is releasably connected along its opposite side edges to the side plates 36 and 38 by a plurality of swing bolts 44 that are pivotally mounted on the side plates by brackets 46.

Figure 2:
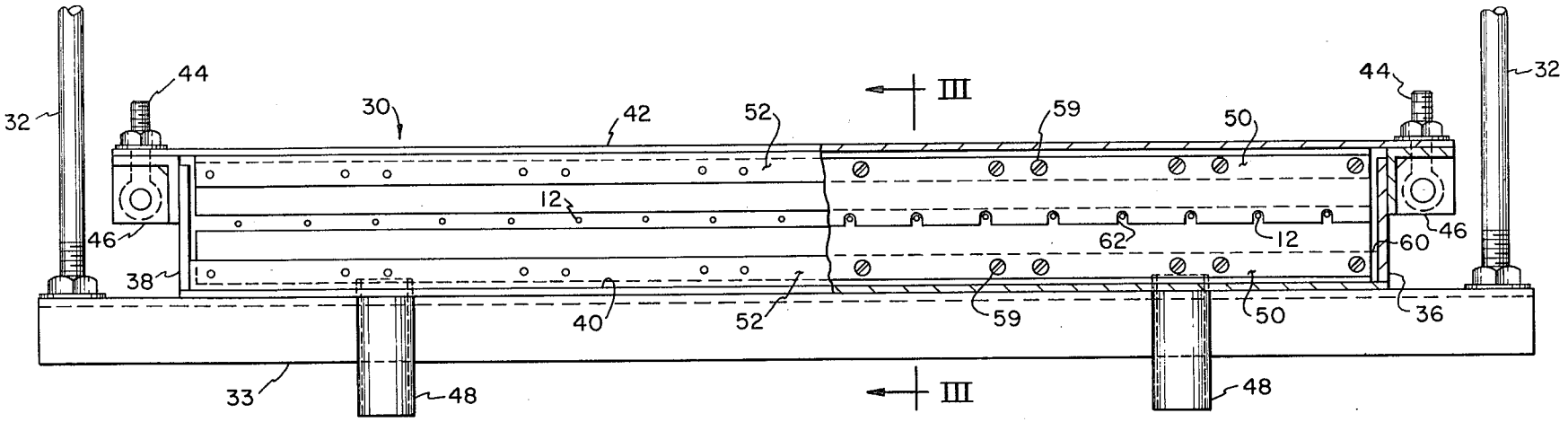
FIG. 2 is an end view, partly in section of the heat exchanger of FIG. 3.
Figure 3:
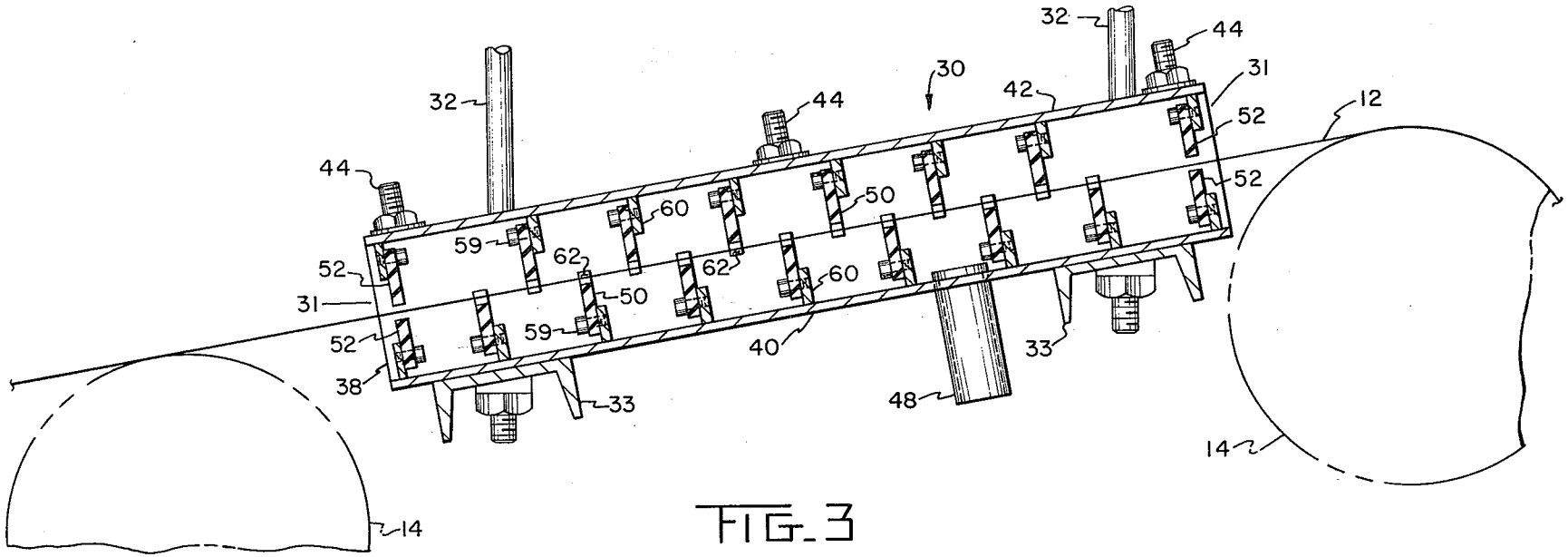
FIG. 3 is an elevational section of a heat exchanger constructed according to the invention.

As shown in FIGS. 2 and 3 the bottom plate 40 of the casing is penetrated at tranversely spaced locations by cooling liquid inlets 48 which are connected to a source of water or the like. Within the casing interior a plurality of opposed, alternately spaced transverse baffles 50 extend upwardly from bottom plate 40 and downwardly from cover 42 to direct the cooling liquid admitted to the casing in direct heat transfer relation to the wire strands 12. The free ends of the baffles 50 are aligned in overlapping relation to one another in order to impart a degree of agitation to the cooling liquid and to direct it along a sinuous course in cross flow relation to the wire strand pass line. Those baffles, indicated as 52, forming the opposite ends of the casing are disposed in vertically aligned, mutually spaced relation in order to define cooling liquid discharge openings at both ends of the casing. Cooling liquid discharged from the ends of the casing 31 is collected in a trough 57 for ultimate disposal or recirculation. A wipe 58 is advantageously positioned adjacent the discharge end of the heat exchanger 30 in order to remove excess liquid from the surface of the wire prior to the application of the wax coating.

In order to accommodate knots or surface irregularities that may exist in the wire strands the baffles 50 and 52 are preferably formed of a resilient, rubber-like material. Their attachment to the casing structure is effected by bolts 59 that threadly engage holes in ribs 60 extending from the surfaces of the bottom plate 40 and cover 42 respectively. Notches 62 formed in the end edges of the baffles 50 serve to permit passage of the wire strands and to guide the same along their respective pass lines. These notches 62 may be either pre-formed in the baffles 50 prior to their installation in the casing or, desirably, are simply formed by the wire strands abrading or cutting into the soft baffle material.

It will be appreciated that the heat exchanger 30 of the present invention has manifold advantages. Cooling by direct heat transfer between the wires 12 and the cooling liquid is augmented because the cooling liquid is agitated; because it is directed in cross flow relation to the wire strands; and because a significant portion of the cooling liquid is directed in counter-flow relation to the movement of wire through the casing 30.

The provision of baffles 52 at the ends of the casing obstruct the flow of cooling liquid therethrough in order to create a body of liquid within the casing of sufficient depth to completely immerse the wires. This feature obviates the need for additional deflector rolls for wire submersion.

The use of flexible baffles permits knots in the wire to pass through the heat exchanger without damaging either the wire or the heat exchanger itself. Additionally, the use of resilient material in the baffles prevents damage to the wire surface and, most importantly, the lateral transposition of the wires between sheave grooves without disrupting line operation. The use of resilient baffles also permits the simultaneous passing of strands of different gage wires through the heat exchanger. Feedup of the device is facilitated by the provision of a removable cover.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Apparatus for cooling continuous lengths of parallel, laterally spaced wires moving along substantially coplanar pass lines comprising:

(a) a substantially enclosed chamber defined by rectangularly disposed bottom and side walls and a removable top wall;

(b) a plurality of longitudinally spaced, resilient plates formed of rubber-like material extending alternately from said chamber top and bottom walls and disposed transversely of said side walls in overlapping relation to said wire pass lines;

(c) recesses in the edges of said plates for guiding said wires along said pass lines;

(d) the opposite ends of said chamber being defined by substantially vertically opposed baffle plates providing spaces at the interfaces thereof for the discharge of cooling liquid from said chamber; and (e) cooling liquid supply means communicating with said chamber intermediate the ends thereof for supplying cooling liquid under pressure to, and substantially filling said chamber for immersing said wires.

* * * * *